United States Patent [19]

Morikami et al.

[11] Patent Number: 4,775,084

[45] Date of Patent: Oct. 4, 1988

[54] ADHESIVE TAPE CASE PROVIDED WITH CUTTER

[75] Inventors: Kenji Morikami, Tokyo; Hiroyasu Kato, Gunma; Masaki Kida, Tokyo; Mituhiro Watabe, Aichi, all of Japan

[73] Assignee: Shachihata Industrial Co., Ltd., Nagoya, Japan

[21] Appl. No.: 949,847

[22] Filed: Dec. 29, 1986

[30] Foreign Application Priority Data

Dec. 28, 1985 [JP] Japan ..... 60-203798
Apr. 8, 1986 [JP] Japan ..... 61-52534

[51] Int. Cl.[4] ..... B65D 85/671
[52] U.S. Cl. ..... 225/15; 225/16
[58] Field of Search ..... 225/16, 10, 11, 47, 225/15; 226/127, 128, 156

[56] References Cited

U.S. PATENT DOCUMENTS 1,746,582 2/1930 Elder ..... 225/15
2,149,088 2/1939 Grunwald ..... 225/16 X
2,206,951 7/1940 Grunwald ..... 225/10
2,601,062 6/1952 Singer ..... 225/16 X
2,675,077 4/1954 Krueger ..... 225/16 X
2,676,765 4/1954 Kaplan ..... 225/16 X

*Primary Examiner*—Frank T. Yost
*Attorney, Agent, or Firm*—Fleit, Jacobson, Cohn & Price

[57] ABSTRACT

An adhesive tape case provided with a cutter has a case body comprising two separable portions. The cutter is fixed adjacent to a tape outlet of the case body. In addition, two rollers for advancing a length of tape is provided adjacent to the tape outlet and driven through two gears. The gears are driven by the operation of an operational knob through a rack plate. The rack plate is adapted to engage with one of the gears when moving forward and to separate therefrom when moving backward. The operational knob is operated on the exterior of the case body or on the inside thereof, depending upon the size of the tape roll employed.

7 Claims, 4 Drawing Sheets

ADHESIVE TAPE CASE PROVIDED WITH CUTTER

BACKGROUND OF THE INVENTION

The present invention relates to an adhesive tape case provided with a cutter, and in particular, to an adhesive tape case provided with a cutter which is capable of storing an adhesive tape wound into a roll in a decent state and of sending out and cutting off a required length of the tape by operating an operational knob.

A known type of conventional adhesive tape case provided with a cutter has a tape hanger for rotatably supporting a tape roll and the case is provided with a tape outlet and a cutter which is raised and set by operating a lever provided in the vicinity of the tape outlet. For example, Japanese Patent Publication No. 5359/1965 discloses an adhesive tape case provided with a cutter of the above-described type.

However, such an adhesive tape case provided with a cutter however, has such a configuration that the end of the tape which is pulled always remains in an exposed state near the tape outlet and, when a required length of the tape is required, it is pinched and pulled out by an appropriate amount, the cutter is then actuated by operating the lever, the tape being cut by applying the portion of the tape which is to be cut against the projected cutter which then cuts it while it is drawn. Consequently, this type of case has a problem in that labor is required for cutting each length of tape and, when a plurality of strips of tape having the same length are required, it is inconvenient because the length of tape to be pulled out has to be visually estimated.

SUMMARY OF THE INVENTION

It is an object of the present invention to provide an adhesive tape case provided with a cutter which is capable of pulling out and cutting off a required length of tape.

It is another object of the present invention to provide a safe adhesive tape case provided with a cutter in which the cutter is fixed within the case without projecting therefrom.

It is a further object of the present invention to provide a low-priced adhesive tape case provided with a cutter which uses only two gears requiring precision and high production costs, requires a small number of parts, and is a source of little trouble.

The invention can provide an adhesive tape cutter provided with a cutter comprising a case body comprising two separable portions, a tape hanger for detachably supporting a tape roll which is disposed within the case body, a delivery means for holding and advancing the forward end of a tape, and a driving means which is adapted to advance a given length of the tape by driving the delivery means.

DESCRIPTION OF THE DRAWINGS

The present invention will now be described in detail with reference to the presently preferred embodiments illustrated in the accompanying drawings in which.

DESCRIPTION OF THE PREFERRED EMBODIMENTS

The present invention will now be described in detail by referring to the embodiments shown in the accompanying drawings.

Figure 1:
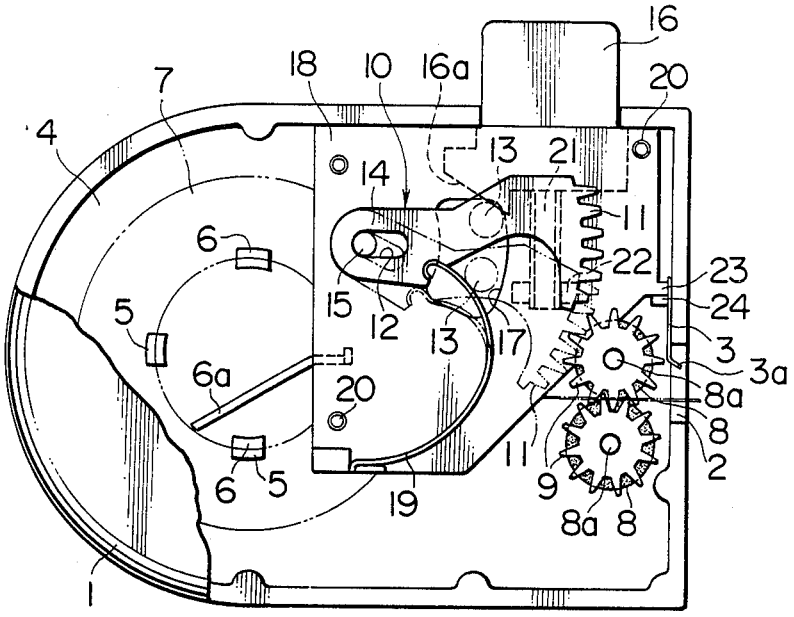
FIG. 1 is a partially cut away plan view showing a first embodiment of an adhesive tape case provided with a cutter.
Figure 2:
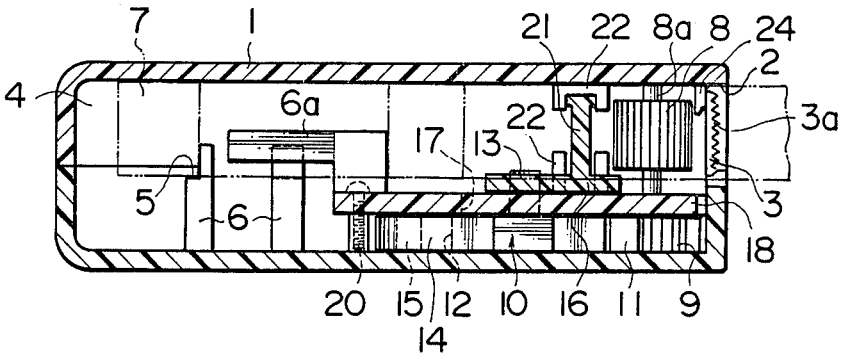
FIG. 2 is a longitudinal section through the first embodiment.
Figure 3:
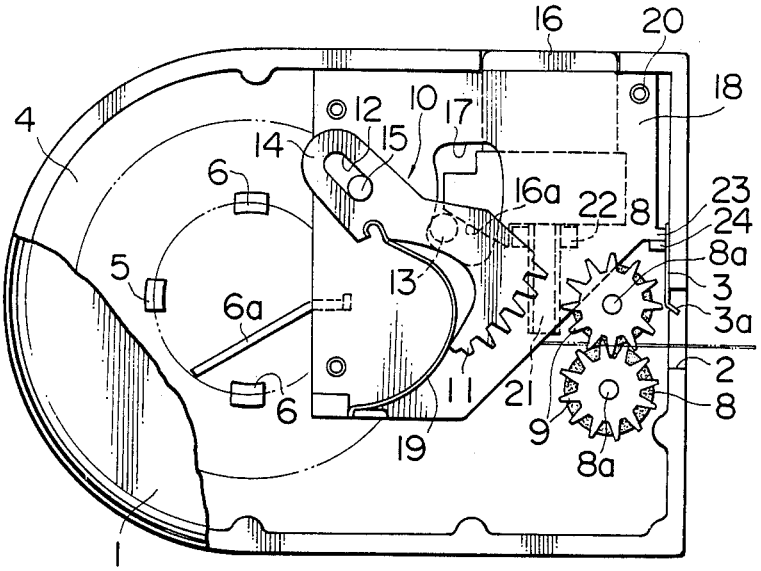
FIG. 3 is a similar plan view to that in FIG. 1 but showing another operational state.

Firstly, as seen in FIGS. 1 to 3, a case body 1 comprises two separable portions made from a synthetic resin material, these two portions being configurated in such a manner that they are tightly held together by projections and grooves (not shown in the drawings) which are provided in these portions. A tape outlet 2 is formed on one side of the case body 1. A cutter 3 is fixed to the inner surface of the case body 1 which is adjacent to one end of the tape outlet 2 and the saw-tooth knife edge 3*a* of the cutter 3 is placed adjacent to one end of the tape outlet 2.

A tape receiving portion 4 is formed in the case body 1 on the side opposite the tape outlet 2. In the tape receiving portion 4, a tape hanger 6 having a step portion is projected from a portion on one side of the case body 1 and an elastic arm 6*a* is provided for the support of a tape roll 7 in cooperation with the tape hanger 6. The elastic arm 6*a* is adapted to support the tape roll 7 in a relatively tight manner so that the tape roll 7 is not slack, and when the tape is pulled out, to enable the rotation of the tape roll, as described hereinafter. As shown in FIG. 2, the step portion 5 of the tape hanger 6 is employed for locating the tape roll 7 at a suitable position in raltation to the tape hanger 6.

Two feed rollers 8, 8 are provided adjacent to the tape outlet 2 in the case body 1. One of the feed rollers is rotatably provided in one of the two separable portions of the case body 1 through a shaft 8*a* and the other feed roller is rotatably provided in the other of the two separable portions of the case body 1 through a shaft 8*a*. Since the two feed rollers are provided in this a manner, when a new tape roll is received in the receiving portion 4 of the case body 1, the end of the tape wound off the tape roller is held between the two feed rollers 8, 8 so that the case body may be easily assembled. One of the feed rollers is made from any suitable elastic material having good releasability relative to an adhesive such as silicon rubber which is applied to one surface of the tape and this roller has a series of grooves formed on the surface thereof which ensure that the tape held between this and the other rollers is delivered assuredly. The other roller is formed such as to have a projection at its center so that it is suitable for pressing the center of the web of the tape held between these rollers on the surface of the above-described roller having the series of grooves.

Gears 9, 9 which are engaged with each other are respectively fixed to the shafts 8*a*, 8*a* on which the two feed rollers 8, 8 are respectively mounted, whereby when one of the gears is driven, the two feed rollers are simultaneously rotated and the tape held therebetween is advanced.

A rotational driving mechanism 10 for driving the two feed rollers through the gears 9, 9 is provided in the case body 1, this rotational driving mechanism 10 comprising a rack plate 14, an operational knob 16, a guide plate 18, and a return spring 19.

A rack portion 11 capable of engaging with one of the gears 9 is formed at one end of the rack plate 14 and a elongated window 12 is formed at the other end and along the length thereof. A pin 13 is projects substantially from the center of one side surface of the rack plate 14 (the upper surface in FIG. 2).

The operational knob 16 has an abutting face **16*a* which is inclined downwardly to the left and which abuts against the pin 13 of the rack plate 14** and pushes it upwardly when pushed downwardly.

The guide plate 18 is fixed to the case body 1 by a screw 20 and has a fixed shaft 15 with which the elongated window 12 of the rack plate 14 loosely engages and a guide window 17 in which the pin 13 of the rack plate 14 is received and is allowed to move.

One end of the return spring 19 is fixed to the lower end of the guide plate 18, as shown in FIG. 1, the other end thereof being stopped by its engagement with an arcuate notch provided at the lower portion of the rack plate 14 (this arcuate notch being located on a line which forms an extension of the elongated window). In an ordinary state in which the operational knob 16 cannot be pushed upwardly, the return spring 19 presses the rack plate 14 upwardly in the counterclockwise direction around the fixed shaft 15 which acts as a fulcrum and thus upwardly presses the operational knob 16 through the pin 13. Furthermore, when the operational knob 16 is pushed, downwardly, the rack plate 14 is rotated clockwise around the filed shaft 15, and the axial direction of the elongated window then substantially matches with the functional direction of the return spring 19, so the return spring 19 performs the action of causing the rack plate 14 to momentarily slide in the functional direction (the obliquely upward direction) of the return spring 19 (this state being shown in FIG. 3).

A guide rod 21 is formed integrally with the operational knob 16 and guides 22, 22 for the guide rod 21 are formed on the guide plate 18 and the case body 1, the operational knob 16 thereby being guided at a right angle relative to the case body 1.

Figure 4:
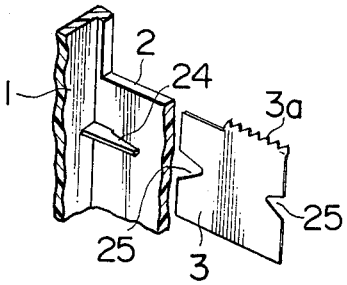
FIG. 4 is a schematically perspective view showing a method for mounting the cutter.

The cutter 3 is provided with notches on both sides thereof, as shown in FIG. 4, and these notches 25, 25 are held between a convex portion 23 provided on the guide plate 18 and a projection 24 provided on the case body 1, whereby the cutter 3 is fixed to the inside of the body 1.

Tape-advancing operations of the adhesive tape case provided with a cutter of the configuration as described above will be explained hereinafter.

In FIGS. 1 and 3, when the operational knob 16 is pushed slightly downward, the abutting face **16*a* of the operational knob 16 pushes the pin 13 of the rack plate 14 downwardly against the spring force of the return spring 19, whereby the rack plate 14 is pivotally moved in the clockwise direction around the fixed shaft 15 of the guide plate 18 which acts as a fulcrum. The rack portion 11 of the rack plate 14 thus engages with the upper gear and rotates it. As a result, the other gear 9 is rotated and the two feed rollers 8, 8 are thereby rotated. Since the feed rollers 8, 8 are rotated by a given amount corresponding to one downward push of the operational knob 16, a given length of tape is delivered from the tape outlet 12 at each downward push of the operational knob 16**.

When the downward push of the operational knob 16 approaches it maximum exctent, the long axis of the rack plate 14 lies in parallel with the abutting face **16*a* of the operational knob 16 and the functional direction of the return spring 19 matches with the axial direction of the elongated window 12 of the rack plate 14, whereby the rack plate momentarily slides in the obliquely upward direction, as shown in FIG. 3, and the fixed shaft 15 slides until it abuts against the end of the elongated window 12, against which it has not previously abuted. Consequently, the rack portion 11 of the rack plate 14 is in a state of being separated from one of the gears 9**.

In the state shown in FIG. 3, when the downward push of the operational knob 16 is released, the rack plate 14 is rotated around the fixed shaft 15 which acts as a fulcrum by the action of the return spring 19 without being brought into contact with one of the gears 9 and is returned to the state shown in FIG. 1.

Therefore, the length of tape corresponds to the number of times the operational knob is pushed downwardly pushing and when the desired length of tape is delivered from the tape outlet 12, the tape is cut by using the cutter 3.

When the operational knob 16 is not pushed downwardly or not completely pushed downward, the rack portion 11 and the gears 9 do not engage with each other and, thus, it is possible to pull out any required length of tape and to cut it.

Additionaly, although, in this embodiment the return spring 19 is separated from the rack plate 14, when the rack plate 14 is made from a tough plastic material such as a polyacetal resin, the return spring 19 may be formed integrally with the rack plate 14 so that it is possible to reduce the number of parts.

A guide pin may be provided on one side surface of the rack portion 11 of the rack plate 14 and a cam groove may be provided on the guide plate 18. This ensures that the above-mentioned operations of the rack plate 14 are performed with certainty.

A second embodiment of the present invention is described hereinafter with reference to FIGS. 5 and 6. This second embodiment is suitable for handling a tape having a large diameter instead of the tape having a small diameter which is an object of the first embodiment.

Members used in the second embodiment having the same configurations and the same functions as those used in the first embodiment are given the same reference numbers.

The second embodiment is substantially the same as the first embodiment except that the structure, the arrangement, and the operations of the operational knob 16 are different from those of the latter. Thus, the description given below will be easily appreciated by reading it paying attention to the point described above.

A tape outlet 2 is formed in a case body 1 comprising two separable portions and a cutter 3 is fixed to the case adjacent to the tape outlet 2. A tape receiving portion is provided in the case body 1 and is formed to allow a tape roll 7 to be accommodated therein.

Two feed rollers 8, 8 are rotatably provided adjacent to the tape outlet 2 of the case body 1 and gears 9, 9 are fixed to the same shaft. A backstop pawl 30 is provided for the feed rollers which acts to prevent them reversing relative to one of the gears 9.

A rotational driving mechanism 10 is provided for driving the feed rollers through the gears 9, 9 and this comprises a rack plate 14, an operational knob 16, a guide plate 18, and a return spring 19.

A rack portion 11 is formed at one end of the rack plate 14 and a elongated window 12 is formed substantially in the middle thereof. A guide pin 12 is formed in the rack portion 11.

The operational knob 16 is provided on the case body 1 in such a manner that it can be rotated around a fulcrum **16*b***.

It has an abutting face and an arcuate concave surface which allows it to be conveniently operated using the thumb.

The guide plate 18 is fixed to the case body 1 by means of a screw 20 and has a fixed shaft 15 with which the elongated window 12 of the rack plate 14 loosely engages and a cam groove 27 in which the guide pin 26 of the rack plate 14 is guided. The guide pin 26 and the cam groove 27 are adapted to sefely perform the below-described operations of the rack plate 14.

One end of the return spring 19 is fixed to the guide plate 18 and the other end thereof is stopped by its engagement with an arcuate notch provided at the lower side of the rack plate 14 (this arcuate notch being located substantially on a line which forms an extension of the elongated window). In the ordinary state in which the operational knob 16 is not being pushed upwardly, the return spring 19 presses the rack plate 14 upwardly in the clockwise direction around the fixed shaft 15 and thus presses downwardly the operational knob through the abutting face **16*a*. In addition, when the operational knob 16 is pushed upwardly, the rack plate 14 is rotated counterclockwise around the fixed shaft 15. Thus, the axial direction of the elongated window is brought into alignment with the functional direction of the return spring 19, wherby the latter acts to momentarily slide the rack plate 14 in the functional direction (obliquely downward) of the return spring 19 (this state being shown in FIG. 6**).

The tape advancing operation of the adhesive tape case provided with a cutter of the above configuration described above will be described hereinafter.

Figure 5:
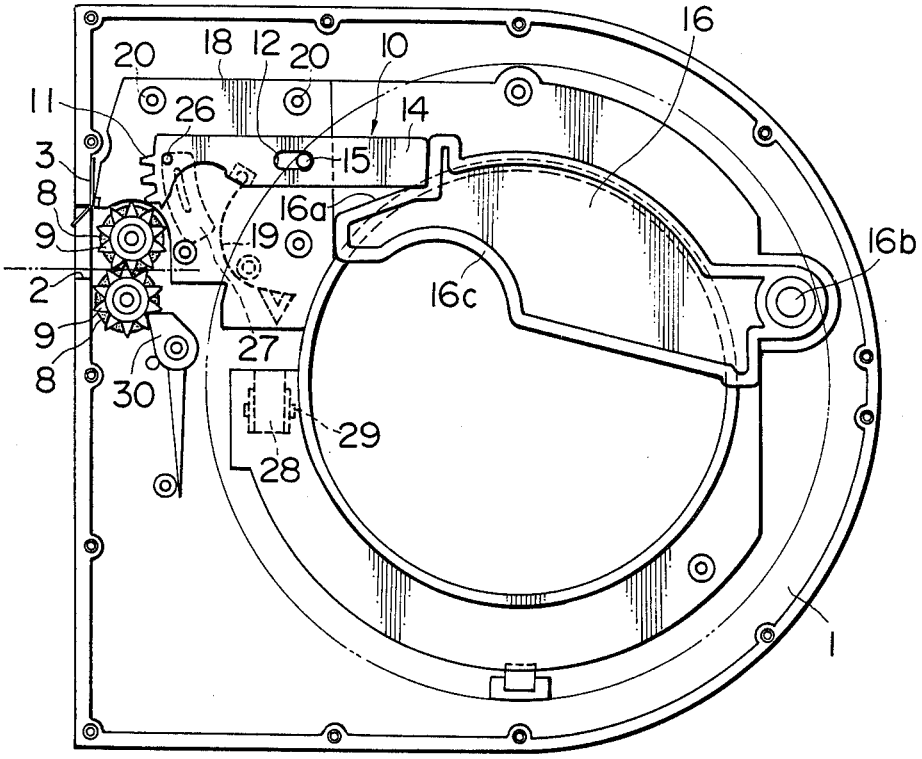
FIG. 5 is a partially cut plan view showing a second embodiment of an adhesive tape case provided with a cutter.
Figure 6:
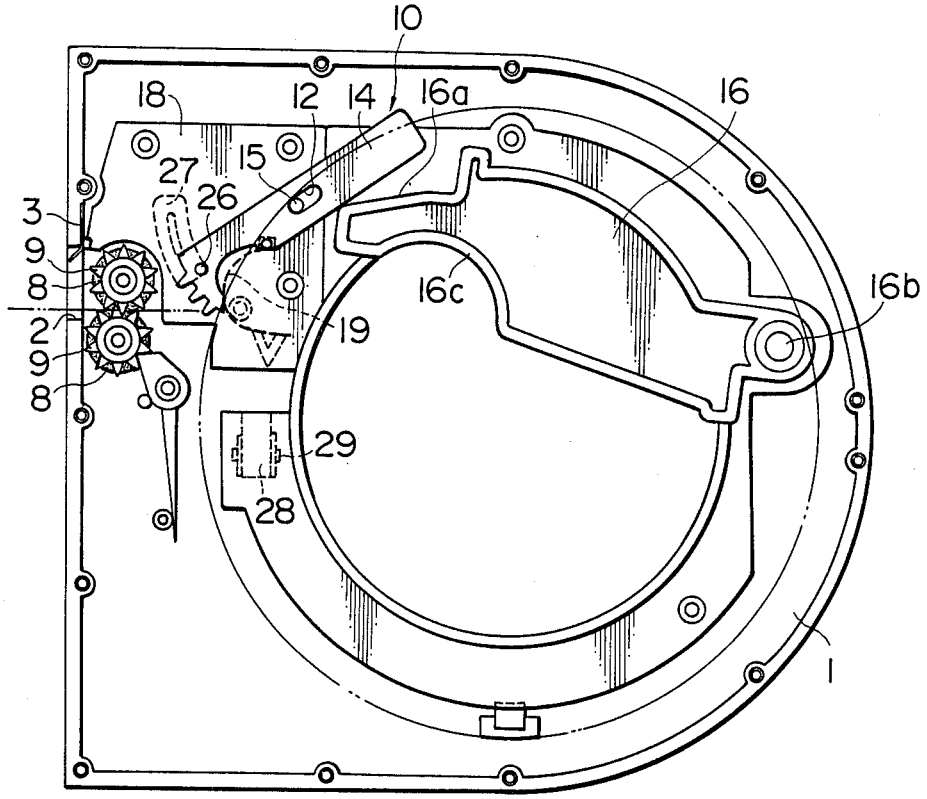
FIG. 6 is a similar plan view to that in FIG. 5 but showing another operational state.

When a thumb is pressed against the arcuate convex portion **16*c* of the operational knob 16 which is thus slightly pudhed upward (as seen in FIGS. 5 and 6), the rack plate 14 is pivotally rotated in the counterclockwise direction around the fixed shaft 15 of the guide plate 18 with which the elongated window of the rack plate 14 is brought into contact. The rack portion 11 of the rack plate 14 is thus engaged with the upper gear 9 and rotates it. As a result, the other gear is also rotated and the two feed rollers are themselves rotated in turn. Since the feed rollers 8, 8 are rotated by a certain amount corresponding to one upward push of the operational knob 16, a certain length of tape is delivered from the tape outlet 2 each time the operational knob 16** is upwardly pushed.

When the upward movement of the operational knob 16 approaches its maximum extent, the functional direction of the return spring 19 is brought into alignment with the axial direction of the elongated window 12 of the rack plate 14 so that the rack plate 14 momentarily slides in the obliquely upward direction and slides until the fixed shaft 15 abuts against the end against which it has not previously abutted. Consequently, the rack portion 11 of the rack plate 14 is put into a state of being separated from the gear 9.

In the state shown in FIG. 6, when the upward manipulation of the operational knob 16 is released, the rack plate 14 is rotated around the fixed shaft 15 by the action of the return spring 19 without being brought into contact with the gears 9 and returns to the state shown in FIG. 1.

A coil spring may be provided on the fulcrum **16*b* of the operational knob 16 so as to supplement the spring force of the return spring 19**.

Furthermore, a rotatable shaft 29 and a projection 28 which is fixed to the shaft 29 and can be rotated within right angles are provided for being adjustable to two different widths of the tapes. More particularly, when the tape of a small width is used, the projection 28 is rotated so as to project inward and thereby accommodating to the width of the tape. On the other hand, when the tape of a large width is used, the projection 29 is maintained to be parallel to the surface of the case body not to be projected inward.

What we claim is:

1. An adhesive tape case including a hollow case body formed with an outlet opening, means provided in said case body for supporting a roll of an adhesive tape in said case body, feed means provided in said case body for drawing said tape out of the case body through said outlet opening, cutter means provided adjacent the outlet opening for cutting said tape, drive means for driving said feed means to thereby draw a desired length of the tape out of the case body, said drive means comprising gear means connected with said feed means, a rack plate formed with rack teeth at one longitudinal end portion, said rack plate being formed at a portion apart from said one longitudinal end portion with an elongated slot which is oriented in a longitudinal direction of said rack plate and engaged with a pin provided on said case body so that the rack plate is movable between an advanced position wherein said pin is engaged with said slot at an end of the slot adjacent to said one longitudinal end portion and a retracted position wherein said pin is engaged with said slot at the other end portion of the slot, said rack plate being further swingable in said advanced position about said pin between a disengaged position wherein said rack teeth are disengaged from said gear means and a gear driving range wherein said rack teeth are engaged with said gear means, resilient means provided between said case body and said rack plate for biasing said rack plate normally toward said disengaged position and additionally toward said retracted position when said rack plate comes to an end of a gear driving stroke in said gear driving range during which tape is delivered from said roll, the end of the gear driving stroke being opposite to the disengaged position, and manual actuating means for swinging said rack plate from said disengaged position to said gear driving range.

2. An adhesive tape case in accordance with claim 1 in which said feed means includes driving roll means coated with a material which is not adherent to the tape.

3. An adhesive tape case in accordance with claim 2 in which said material coated on said roll means is silicone rubber.

4. An adhesive tape case in accordance with claim 1 in which said resilient means includes a leaf spring.

5. An adhesive tape case in accordance with claim 1 in which said manual actuating means is a manually actuated handle.

6. An adhesive tape case in accordance with claim 5 in which said handle is formed with stop means engageable with the other end of the rack plate to prevent said rack plate from moving toward said retracted position until the rack plate swings to said end of the gear driving stroke opposite to the disengaged position.

7. An adhesive tape case in accordance with claim 1 in which guide means is provided between said case body and said rack plate for guiding said rack plate when said rack plate is in said advanced position between said disengaged position and said gear driving range.

* * * * *

UNITED STATES PATENT AND TRADEMARK OFFICE

CERTIFICATE OF CORRECTION

PATENT NO. : 4,775,084

DATED : October 4, 1988

INVENTOR(S) : Kenji MORIKAMI et al.

It is certified that error appears in the above-identified patent and that said Letters Patent is hereby corrected as shown below:

At the title page, item [21], the correct application number is --946,847--.

Signed and Sealed this

Fifth Day of October, 1993

*Attest:*

*Attesting Officer*

BRUCE LEHMAN

*Commissioner of Patents and Trademarks*